United States Patent [19]

Glen et al.

[11] Patent Number: 5,027,602

[45] Date of Patent: Jul. 2, 1991

[54] HEAT ENGINE, REFRIGERATION AND HEAT PUMP CYCLES APPROXIMATING THE CARNOT CYCLE AND APPARATUS THEREFOR

[75] Inventors: John S. Glen, Deep River, Canada; Thomas C. Edwards, Rockledge, Fla.

[73] Assignee: Atomic Energy of Canada, Ltd., Ontario, Canada

[21] Appl. No.: 538,810

[22] Filed: Jun. 15, 1990

Related U.S. Application Data

[63] Continuation of Ser. No. 395,630, Aug. 18, 1989, abandoned.

[51] Int. Cl.[5] ..... F01K 25/10

[52] U.S. Cl. ..... 60/651; 60/649; 60/671

[58] Field of Search ..... 60/651, 670, 671, 649

[56] References Cited

U.S. PATENT DOCUMENTS

| | | | |
|---|---|---|---|
| 3,006,146 | 10/1961 | Jackson | 60/649 X |
| 3,055,170 | 9/1962 | Westcott, Jr. . | |
| 3,400,555 | 9/1968 | Granryd . | |
| 3,545,216 | 12/1970 | Chawla . | |
| 3,913,351 | 10/1975 | Edwards . | |
| 3,938,335 | 2/1976 | Marwick . | |
| 3,967,466 | 7/1976 | Edwards . | |
| 3,972,195 | 8/1976 | Hays et al. . | |
| 3,977,852 | 8/1976 | Edwards . | |
| 3,995,428 | 12/1976 | Roberts . | |
| 4,017,285 | 4/1977 | Edwards . | |
| 4,027,993 | 6/1977 | Wolff . | |
| 4,064,705 | 12/1977 | Edwards et al. . | |
| 4,089,177 | 5/1978 | Olofsson . | |
| 4,106,294 | 8/1978 | Czaja . | |
| 4,141,219 | 2/1979 | Elliott . | |
| 4,143,516 | 3/1979 | Long . | |
| 4,240,259 | 12/1980 | Vincent | 60/670 |
| 4,241,591 | 12/1980 | Edwards . | |
| 4,249,384 | 2/1981 | Harris | 60/670 |
| 4,258,551 | 3/1981 | Ritzi . | |
| 4,258,553 | 3/1981 | Kelly et al. . | |
| 4,262,485 | 4/1981 | Kuroda et al. . | |
| 4,283,915 | 8/1981 | McConnell et al. . | |
| 4,298,311 | 11/1981 | Ritzi . | |
| 4,306,414 | 12/1981 | Kuhns . | |
| 4,355,515 | 10/1982 | Cohen et al. . | |
| 4,410,305 | 10/1983 | Shank et al. . | |

(List continued on next page.)

FOREIGN PATENT DOCUMENTS

| | | |
|---|---|---|
| 1029569 | 4/1978 | Canada . |
| 1109038 | 9/1981 | Canada . |
| 2759096 | 7/1978 | Fed. Rep. of Germany . |
| 8809872 | 12/1988 | World Int. Prop. O. . |

OTHER PUBLICATIONS

O. Badar, P. W. O'Callaghan, M. Hussein, S. C. Probert, Multi-Vane Expanders as Prime Movers for Low Grade Energy Organic Rankine-Cycle Engines, Applied Energy 16 (1984), pp. 129–140.

N. Arai, K. Matsubara, "Scroll & Screw Compressors: The Latest Compressor Technology for Air Conditioning and Refrigeration", Hitachi Review, vol. 34, No. 3, 1985, pp. 141–146.

(List continued on next page.)

*Primary Examiner*—Allen M. Ostrager

*Attorney, Agent, or Firm*—John E. Toupal; John W. Ross; Harold G. Jarcho

[57] ABSTRACT

A process and apparatus by means of which the premier vapor cycle, known as the Carnot cycle, can be approximated in practice, involve the application of novel energy-efficient, mixed phase, high volume-ratio fluid-handling machinery to a single-component working fluid that exists during certain processes as a mixture of fine droplets of saturated liquid in saturated vapor. This combination of fluid-handling machinery and the saturated mixed-phase working fluid enables the approximation of isentropic saturated liquid/vapor expansion and compression. These process approximations, in addition to isothermal heat addition and rejection, enable Carnot heat engine, refrigeration and heat pump cycles to be approximated.

29 Claims, 6 Drawing Sheets

U.S. PATENT DOCUMENTS

| | | | |
|---|---|---|---|
| 4,437,308 | 3/1984 | Fischer . | |
| 4,441,322 | 4/1984 | Ritzi . | |
| 4,475,343 | 10/1984 | Dibelius et al. . | |
| 4,479,354 | 10/1984 | Cosby . | |
| 4,574,592 | 3/1986 | Eskeli . | |
| 4,578,943 | 4/1986 | Scampini . | |
| 4,663,939 | 5/1987 | Cosby . | |
| 4,738,111 | 4/1988 | Edwards . | |
| 4,876,855 | 10/1989 | Yogev et al. | 60/651 |

OTHER PUBLICATIONS

S. E. Eckard, "Multi-Vane Expander as Prime Mover in Low Temperature Solar or Waste Heat Applications", IECEC 1975, pp. 1399-1405.

H. Holcroft, "Condensing by Compression: A Locomotive Experiment", The Engineer, 6 Sep. 1946, pp. 202, 203, 13, Sep. 1946, pp. 227, 229, 20 Sep. 1946, pp. 248, 249 and subsequent letters of Oct. 4/46; Oct. 11, 18/46; Nov. 15/46; Dec. 6, 20/46; Jan. 17, 24/47; Mar. 21/47; May 9, 23/47.

U. K. Patent 271,929, "Improvements in Steam Power Installations", 1 Jun. 1927.

U. K. Patent 290,783, "Improvements Relating to Conservation of Heat in a Steam Powered System", 24 May 1928.

Anderson's Compression System-Observations on Patent Specifications-by H. Holcroft (undated).

C. Hickman, W. E. J. Neal, "Implications of Cooling Rotary Sliding Vane Heat Pump Compressors", Int. J. Ambient Energy V5N4, Oct. 1984.

Shao-Kai Yang, Sen-Quan Zhou, Si-Yang Sun, "International Water-Spray Cooling of the Reciprocating Compressor", 1988 International Compressor Engineering Conference at Purdue, West Lafayette, Ind., 1988 Jul. 18-21, vol. 2, pp. 526-531.

CARNOT CYCLE ON T-s DIAGRAM

CARNOT CYCLE ON p-h DIAGRAM

RANKINE CYCLE ON p-h DIAGRAM

CONVENTIONAL REFRIGERATION AND HEAT PUMP CYCLE

CARNOT REFRIGERATION AND HEAT PUMP CYCLE

HEAT ENGINE, REFRIGERATION AND HEAT PUMP CYCLES APPROXIMATING THE CARNOT CYCLE AND APPARATUS THEREFOR

This application is a continuation of Ser. No. 07/395,630 filed Aug. 18, 1989, inventors John S. Glen and Thomas C. Edwards entitled "Heat Engine, Refrigeration and Heat Pump Cycles Approximating the Carnot Cycle and Apparatus Therefor", now abandonded.

BACKGROUND AND INTRODUCTION

This invention relates to processes and apparatus, including novel compressors and expanders, by means of which improved high efficiency vapour cycles such as Carnot heat engine, refrigeration and heat pump cycles can be approximated in actual practice.

In essence, the Carnot heat engine cycle is composed of four ideal processes: (a) isothermal (zero temperature difference) working fluid heat addition at the desired high temperature, (b) isentropic working fluid expansion (work production), (c) isothermal (zero temperature difference) heat rejection at the desired low temperature and (d) isentropic working fluid compression (work absorption).

Carnot refrigeration and heat pump cycle approximations are also possible, as outlined later. For clarity, most of the background discussion which follows is based on the Carnot heat engine cycle.

Until now, the most energy-efficient heat engine cycle, the above-described Carnot cycle, has been considered merely a theoretical basis upon which to evaluate other practical heat engine cycles and real machinery. This is poignantly outlined in the following quotation from the "Mechanical Engineer's Reference Book", Butterworth Publishers, Boston, 11th Edition, 1986:

> "The cycle for the ideal heat engine is known as the Carnot cycle, but has little use in real plants as it is not composed of the steam or gas processes which are found suitable for practical machinery."

> "The thermal efficiency of the Carnot cycle is of use to the engineer as it gives him the maximum value that he could attain between given temperature limits".

Partly because the Carnot cycle, until now, could not itself be actualized or closely approximated, other heat engine conversion cycles have been developed. These heat engine cycles have been primarily based upon the actual machinery and working fluids that were available. For example, the Otto cycle is approximated in practice by the spark ignition engine and the Diesel cycle by the compression-ignition engine. The theoretical heat conversion cycle that is most similar to the Carnot cycle is the Rankine cycle; it is approximated in such applications as steam power plants. Consider the following passage from a college thermodynamics text book, "Thermodynamics", G. J. Van Wyler, Editor, J. Wiley & Sons, Publishers, 1962:

> ". . . It is readily evident that the Rankine cycle has a lower efficiency than the Carnot cycle with the same maximum and minimum temperatures as a Rankine cycle, because the average temperature of heat addition is below the temperature of evaporation. The question might well be asked, why choose the Rankine cycle as the ideal cycle? Why not rather select the Carnot cycle? At least two reasons can be given. The first involves the pumping process. Great difficulties are encountered in building a pump that will handle a mixture of liquid and vapour (coming from the low temperature isotherm—the condenser) and deliver only saturated heated liquid (to the high temperature isotherm—the boiler). It is much easier to completely condense the vapour and handle only liquid in the pump, and the Rankine cycle is based upon this fact. The second reason involves superheating the vapour. In the Rankine cycle, the vapour is superheated at constant pressure. In the Carnot cycle, all the heat transfer is at constant temperature, and therefore the vapour is superheated (assuming single-phase working fluid). However, during this process, the pressure must drop, which means that the heat must be transferred to the vapour as it undergoes an expansion process in which work is done. This is also very difficult to achieve in practice. Thus, the Rankine cycle is the ideal cycle that can be approximated in practice".

The above conclusion, that for practical reasons one must resort to the lower efficiency Rankine heat engine cycle rather than the Carnot cycle, has been a persuasive one and the classical approach to the Carnot cycle has discouraged most people from even attempting to closely approximate this ideal cycle. Similar considerations have applied in respect of refrigeration and heat pump cycles.

BRIEF SUMMARY OF INVENTION

The present invention, which, as will be seen hereafter, involves the "marriage" of innovations in controlling and accommodating the physical phase composition of the working fluid with new and innovative high efficiency machines (expanders and compressors), makes possible a reasonable approximation to the Carnot cycle in respect of heat engine, refrigeration and heat pump applications.

Accordingly, one aspect of the present invention provides process and apparatus by means of which the Carnot cycle can be approximated in practice. The invention involves the application of novel energy-efficient, mixed phase, high volume/ratio fluid-handling expanders and compressors to a single-component working fluid that exists as a mixture of fine droplets of saturated liquid in saturated vapour. This combination of fluid-handling expanders and compressors with the saturated mixed-phase working fluid enables the approximation of isentropic saturated liquid/vapour expansion and compression. These process approximations, in addition to isothermal heat addition and rejection, enable Carnot heat engine, refrigeration and heat pump cycles to be approximated.

Further, according to another aspect of the invention, improvements over the novel high efficiency, high volume ratio compressors and expanders of the constrained vane variety illustrated, e.g. in U.S. Pat. Nos. 4,299,097 and 4,410,305 include the provision of unique compressor/expander chamber shapes, as the case may be, enabling relatively high efficiencies and high volume ratios to be achieved.

DETAILED DESCRIPTION OF PREFERRED EMBODIMENTS THE CARNOT AND RANKINE CYCLES

Figure 1:
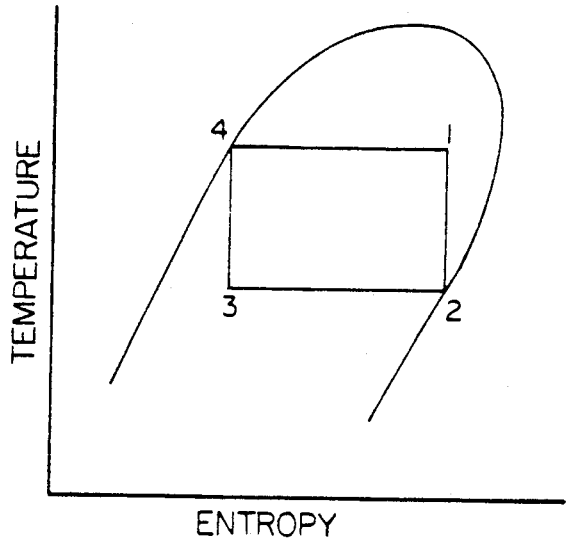
FIG. 1 is a temperature-entropy diagram (T-s) of the Carnot cycle.
Figure 2:
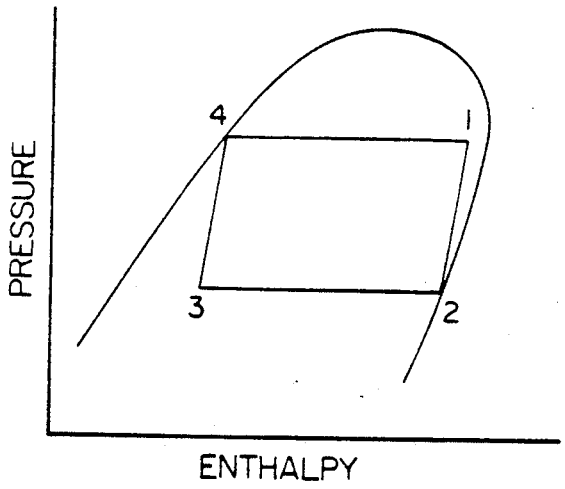
FIG. 2 is a pressure-enthalpy diagram (p-h) of the Carnot cycle.

To review, the Carnot cycle is defined as consisting of four special thermodynamic processes: Two isothermal heat transfer processes and two isentropic work processes. In a temperature-entropy (T-s) diagram, the Carnot cycle appears as a rectangle as shown in FIG. 1, with the "dome" representing the saturated liquid-vapour phase diagram of a typical organic compound. The two horizontal lines respectively represent isothermal heat addition and rejection. The right vertical line represents isentropic expansion (work output) and the left vertical line represents isentropic compression (work input). On a pressure-enthalpy (p-h) diagram, the Carnot cycle appears somewhat like a rhomboid as depicted in FIG. 2.

Figure 3:
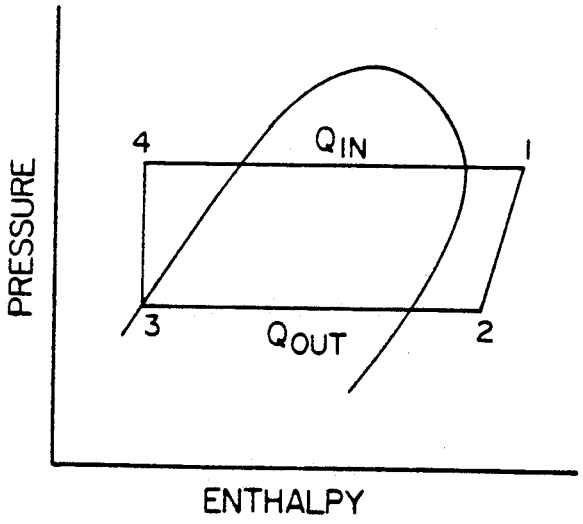
FIG. 3 is a pressure-enthalpy diagram (p-h) of the Rankine cycle.

It is instructive to consider the Rankine cycle, also depicted on a pressure-enthalpy diagram, because the similarities and differences between the two cycles become readily apparent. FIG. 3 shows the Rankine cycle on a p-h diagram.

It is immediately apparent that both the Carnot and Rankine cycles have isothermal heat addition and heat rejection processes as shown by the two sets of parallel horizontal lines. However, considerably more heat is added in the Rankine cycle (process 4-1) than in the Carnot cycle. Further, and consequentially, more heat is rejected by the Rankine cycle than the Carnot cycle (process 2-3). Significant differences between the two cycles occur during the work processes (1-2) (expansion) and (3-4) (compression and/or pumping). For example, using an organic fluid with "dome" lines as shown here, the Rankine cycle begins (generally) slightly superheated at state point (1) and expands isentropically to state point (2) where further superheat of the working fluid is reached for some working fluids. On the other hand, the Carnot cycle as described here begins its expansion inside the "dome" at state point (1) (i.e. a mixture of liquid and vapour) and expands at constant entropy (as prescribed here) to a saturated vapour phase at state point (2).

In the Rankine cycle, all the working fluid is condensed to a liquid state (3) and is then pumped from the lower pressure in the condenser to the higher pressure in the boiler (state point 4). The Carnot cycle, however, only partially condenses the working fluid during the process from state point (2) to state point (3). This requires that a mixture of liquid and vapour phase working fluid at a state point (3) must be compressed as a mixture and pumped into the boiler at state point (4). This compression/pumping process accommodates the "incomplete" condensation occurring in the condenser. The compressor/pump collapses the vapour portion of the two-phase mixture substantially to hot liquid. In the process of mixed-phase compression as provided by the present invention, the saturated vapour transfers the heat of compression to finely dispersed liquid phase droplets entering the compressor/pump (which finely dispersed droplets are provided by means to be described hereafter). In a direct sense, the condensation process is completed through the application of work in the compressor/pump rather than by heat transfer occurring in the condenser. The following section discusses specific means to effect a real Carnot engine. Subsequent sections discuss a detailed embodiment and presents specifics of the expander and compressor/pump fluid-handling machinery.

Figure 4:
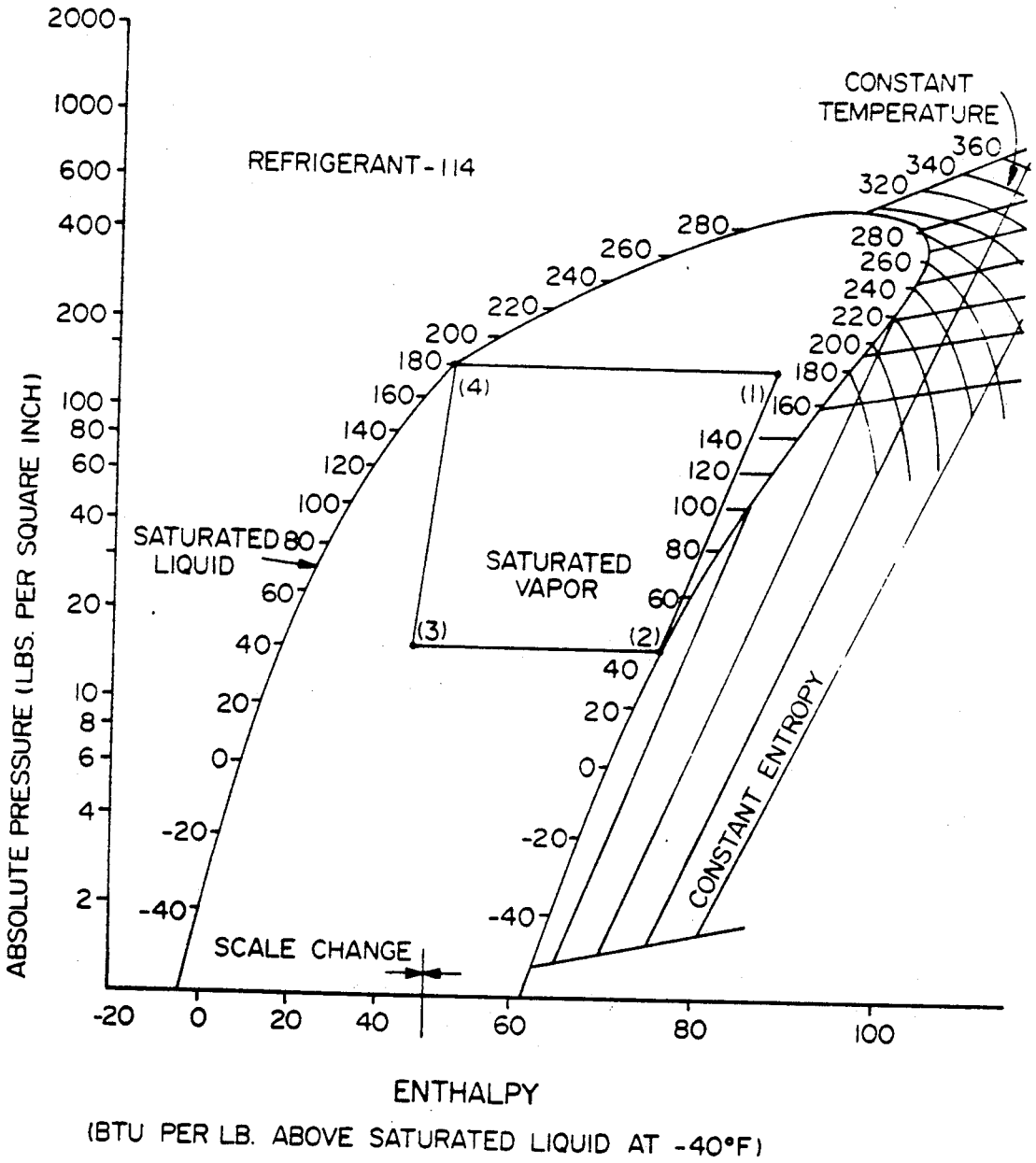
FIG. 4 shows a Carnot cycle superimposed on a portion of a temperature-enthalpy (T-h) diagram for refrigerant CFC-114.

FIG. 4 shows a Carnot cycle superimposed on a temperature-enthalpy diagram for refrigerant CFC-114. The calculations for cycle efficiency set out below shows how the expander and compressor/pump efficiencies $\eta$ exp and $\eta$ comp respectively, influence the overall cycle efficiency.

$$\text{Carnot} = \frac{T_1 - T_2}{T_1} = \frac{180 - 40}{180 + 460} = 21.7\%$$

$$\text{cycle} = \frac{(88.07 - 75.81)\eta\text{exp} - (52.687 - 48.1)x - \frac{1}{\eta}\text{comp}}{88.07 - 52.687}$$

$$= \frac{(12.26\eta\text{exp} - 4.587)x\,\frac{1}{\eta}\text{comp}}{35.383}$$

= 21.7% (for isentropic expansion and compression, numerical values being taken from ASHRAE, 1981 Fundamentals Handbook pp. 17, 23.

With a perfect expander and compressor, the cycle efficiency equals the Carnot efficiency. However, it is apparent from calculations that with an inefficient expander and compressor pump, the actual Carnot cycle engine efficiency can fall well below the Rankine efficiency. The reason that an actual Carnot engine is more sensitive to machine efficiencies than the Rankine cycle is because the compressor/pump "back-work" term is considerably larger than the liquid pump term of the Rankine cycle. Typically, the Carnot engine's compressor/pump energy requirement is on the order of $\frac{1}{4}-\frac{1}{3}$ of the expander work output. In the Rankine cycle this term is often less than 2% of expander work output.

THE CARNOT ENGINE

Figure 5:
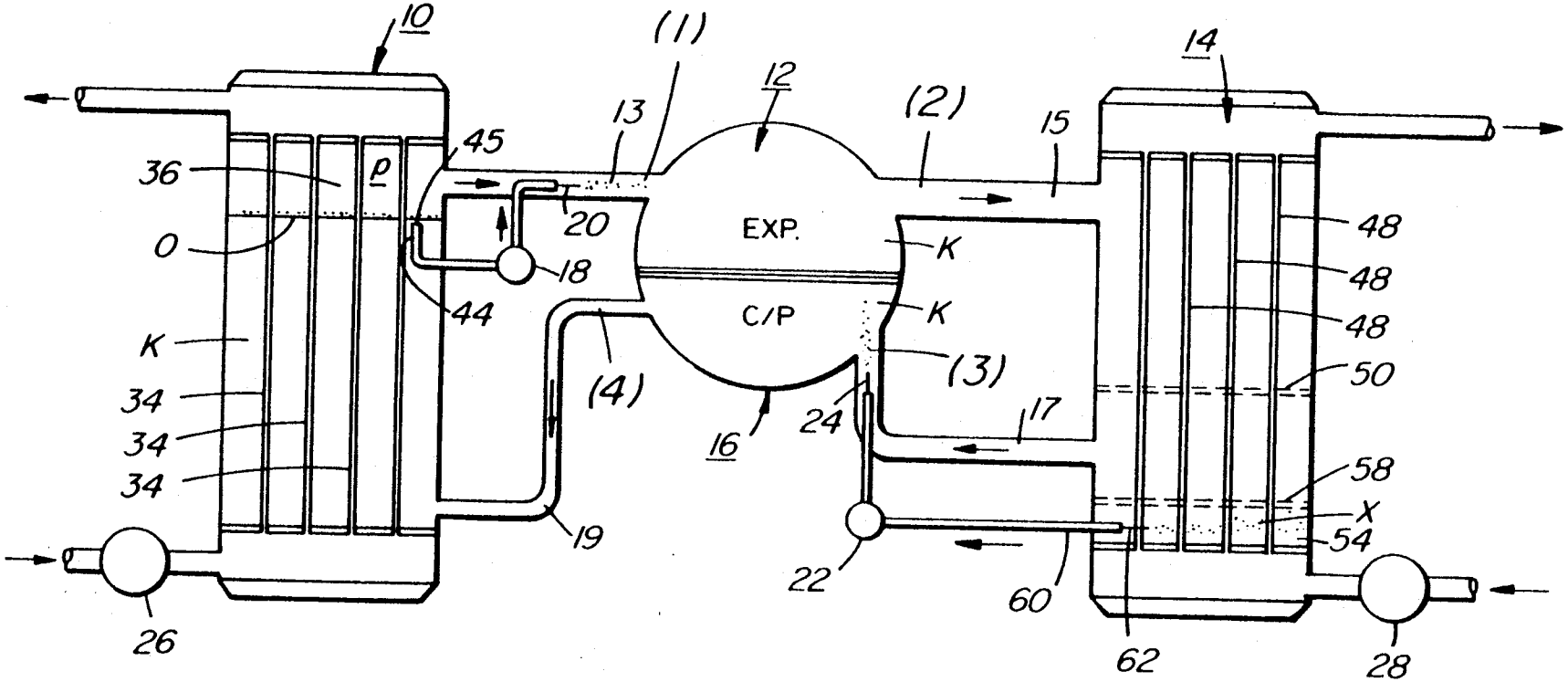
FIG. 5 is a layout of the Carnot cycle heat engine approximation of the present invention.

FIG. 5 presents a detailed schematic layout of the Carnot engine approximation according to the present invention. The engine as shown comprises four primary components: The boiler 10, the expander 12, the condenser 14, and the compressor/pump 16. Boiler 10 is connected to the inlet of expander 12 by a boiler outlet line 13 while the expander outlet for "spent" gas is connected to the condenser inlet via condenser inlet line 15. Compressor/pump inlet line 17 leads from the condenser outlet to the compressor/pump inlet. The compressed hot liquid from the compressor/pump enters the boiler 10 through the boiler inlet line 19. Secondary components include an expander inlet injection pump 18, the outlet of which is connected to expander inlet liquid spray nozzle 20 located in boiler outlet line 13. A compressor/pump inlet injection pump 22 has its outlet connected to a compressor/pump inlet liquid spray nozzle 24 disposed in inlet line 17 leading to the compressor/pump inlet. Also noted in FIG. 5 is a boiler hot water circulating pump 26 and a condenser cold water circulating pump 28. The working fluid, which displaces the inside volume of the engine loop, is denoted K.

In the present layout, it is convenient to begin with considering a flow of high temperature water from a heat source (not shown) into the boiler as a result of the action of boiler hot water circulating pump 26. As the hot water flows upwards in the boiler heat exchanger tubes 34, heat is transferred to the surrounding organic working fluid K. This heat input to the boiler 10 causes the working fluid K to vaporize and emerge at the top region 36 of the boiler. The interface between the liquid and vapour in the boiler is indicated as 0. The saturated vapour, denoted p, then leaves the boiler via outlet line 13. In the meantime, liquid injection pump 18 draws liquid from the boiler via an open draw line 44 having an up-turned inlet end 45. The vertical position of the upturned inlet end 45 of this liquid draw line 44 determines the liquid level in the boiler if the pumping capacity of the liquid injection pump 18 is sufficiently high. This (sufficient pumping capacity) is a desirable condition, of course, because the liquid flow rate will be caused to stabilize at the required value at design operation and working fluid charge level. It also ensures that the maximum boiler heat transfer tube area is in contact with liquid phase, thus maximizing the performance of the boiler 10.

The action of the injection pump 18 in combination with the spray nozzle 20 and the inlet saturated vapour p yields a finely dispersed high pressure mixture of very small liquid droplets suspended in the vapour. This homogeneous dual-phase working fluid then enters the expander 12 at state point (1). Next, the working fluid at state point (1) expands in the expander 12 to state point (2). For analytical and practical purposes, the amount of liquid spray injected into the vapour at state point (1) should be such that the low pressure expanded or "spent" gas reaches state point (2) with a quality of 100% (i.e. saturated vapour). This can be seen in FIG. 2 in the lower right-hand corner.

During the expansion process, the lowering of the pressure of the vapour surrounding the suspended liquid droplets causes the droplets to evaporate. This evaporation process is tantamount to adding heat to the gas during expansion. Such action, of course, increases the work done as the expansion process proceeds, and therefore the net expander power output.

As the "spent" vapour enters the condenser 14 through the condenser inlet line 15, it comes in contact with heat exchanger tubes 48. These tubes are cooled through the action of cold water flowing through them that is pumped by the condenser water pump 28. Since in a real machine some losses will occur, the temperature of the working fluid at state point (2) will be slightly above the ideal saturated value that should enter the compressor/pump 16. Therefore, baffle 50 ensures that the upper tubes 48 chill the vapour to the saturation temperature.

Next, the chilled vapour leaves the condenser 14 on its way to the compressor/pump 16 through pump compressor/inlet line 17. In the meantime, the condensed liquid collects in the bottom region 54 of the condenser. The interface between the vapour and liquid phase in the condenser is denoted X. Baffle 58 ensures that liquid "splashing" does not occur so that no liquid will enter compressor/pump inlet line 17. The collected condensed liquid W then enters the liquid injection line 60 at the line's end, 62. Again, the use of an "over capacity" liquid pump 22 ensures that all of the condensed liquid enters the compressor/pump and that the condenser remains essentially "dry". This is important because the maximum amount of condenser tube area should be in contact with vapour.

Through the combined action of the liquid injection pump 22 and spray nozzle 24, the condensed liquid is "atomized" at 24 as very small liquid droplets and mixes with the vapour passing through compressor/pump inlet line 17. This mixed-phase working fluid, K, then exists at state point (3) just prior to entering the compressor/pump 16.

As the finely mixed saturated liquid droplets and vapour are captured by the compressor/pump 16, the vapour phase is compressed. This input work causes an increase in the vapour temperature and pressure. As the vapour temperature increases, the tiny liquid droplets absorb the heat, so that the temperature of the dual-phase mixture stays lower than it would without the liquid droplets. Since the pressure is also increasing as a result of the compression, but the temperature is being simultaneously lowered by heat flowing to the existing liquid droplets, the vapour phase portion of the mix converts to liquid. This (essentially) fully-condensed hot liquid then enters the boiler through boiler inlet line 19 where it re-evaporates in order to continue and repeat the cycle.

It is important to understand that this invention is not limited to the liquid atomization means (pump and spray nozzle) as outlined herein. For example, common Venturi embodiments can be used that are similar to the action of internal combustion engine carburetors that "atomize" the liquid gasoline. It is also important to realize that the level of approximation to isentropic compression and expansion processes is a function of droplet size. This is because there is (essentially) no limit to the area that can be made available for the intra-working fluid heat transfer processes. Said differently, by greatly decreasing the size of the individual liquid particles (and, therefore, greatly increasing their number), extremely large heat transfer areas are available. Large intra-fluid heat transfer area permits very close temperature "tracking" between the two phases of the working fluid.

By injecting the "misted" liquid working fluid component into the vapour component of the working fluid, a "homogeneous" mixed-phase working fluid is created. This mixed-phase working fluid thus accrues special properties. The property arises as a result of the continuous thermodynamic property changes that the mixed-phase working fluid undergoes as heat is transferred across the liquid-to-vapour or vapour-to-liquid boundaries created by the fine mixture of liquid and gas.

Consider the organic working fluid CFC-114. When undergoing expansion, for example, this single-component mixed-phase working fluid naturally experiences ever-lowering pressure and temperature. The thermophysical properties of CFC-114 cause the liquid droplets to evaporate into the existing vapour. This process, if carried out adiabatically on the macroscopic scale, but isothermally on a "microscopic" scale (heat transfer between the droplets and the surrounding vapour), can approximate an isentropic expansion process. That is, as entropy is gained by the vapour component (heat being transferred to the vapour), entropy is lost by the liquid component (heat being transferred from the liquid) in equal amount, thereby approximating an acutal two-phase isentropic expansion process. Of course, the mixed-phase compression process is directly similar to expansion, except that heat entropy is gained by the liquid and lost by the vapour.

In the limit (infinitely small liquid droplets and infinite heat transfer area), the mixed-phase working fluid volume-changing processes would actually be isentropic, assuming no machine irreversibilities or heat transfer. Because in practice it requires only small amounts of energy to "atomize" liquids into small droplets, the net area for heat exchange between the liquid and the vapor phases can become very large at low energy expense. It is believed to be these facts, in combination with high efficiency high volume ratio machines, that make the approximation of the Carnot cycle possible.

HIGH VOLUME RATIO MACHINES

Due to the extreme changes in volumetric requirements resulting from actualizing the Carnot cycle with dual-phase working fluids, new fluid-handling machines were, as a part of this invention, required to manage these large changes in volume. Of course, because the most drastic changes in displaced volume take place in the compressor/pump, this machine presented the highest design challenge. In a specific example, using n-Butane (R-600) as the working fluid across 180F and 40F, the volume ratio for the expander is approximately 8.8 to 1. While this is a relatively large value which cannot be accommodated by prior art machines, the compressor/pump volume ratio requirement under these same conditions is in the order of 70 to 1 as will be seen from the example which follows.

Figure 6:
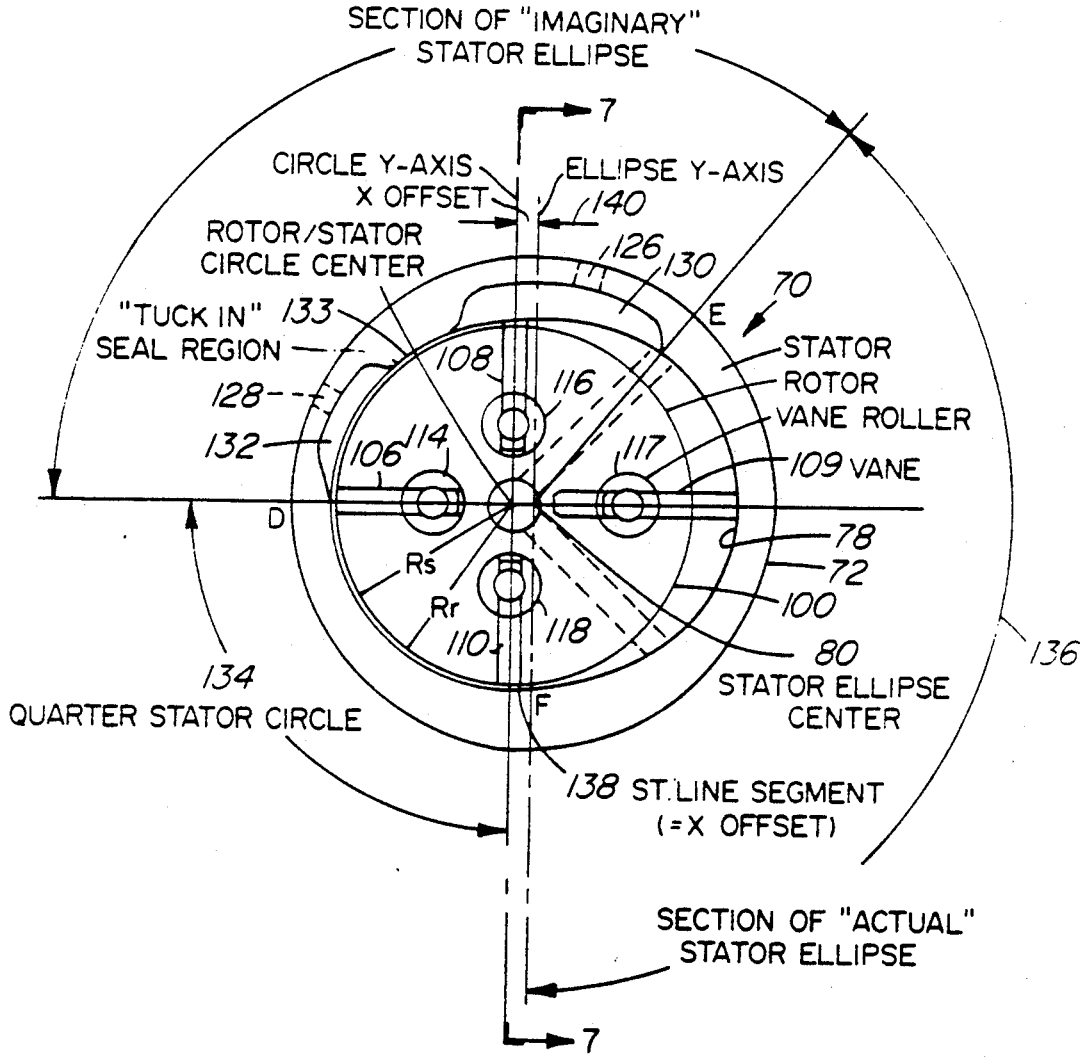
FIGS. 6 and 7 are views of high efficiency compressors and expanders in accordance with the present invention, FIG. 6 being a simplified and annotated section view taken along line 6—6 of FIG. 7.
Figure 7:
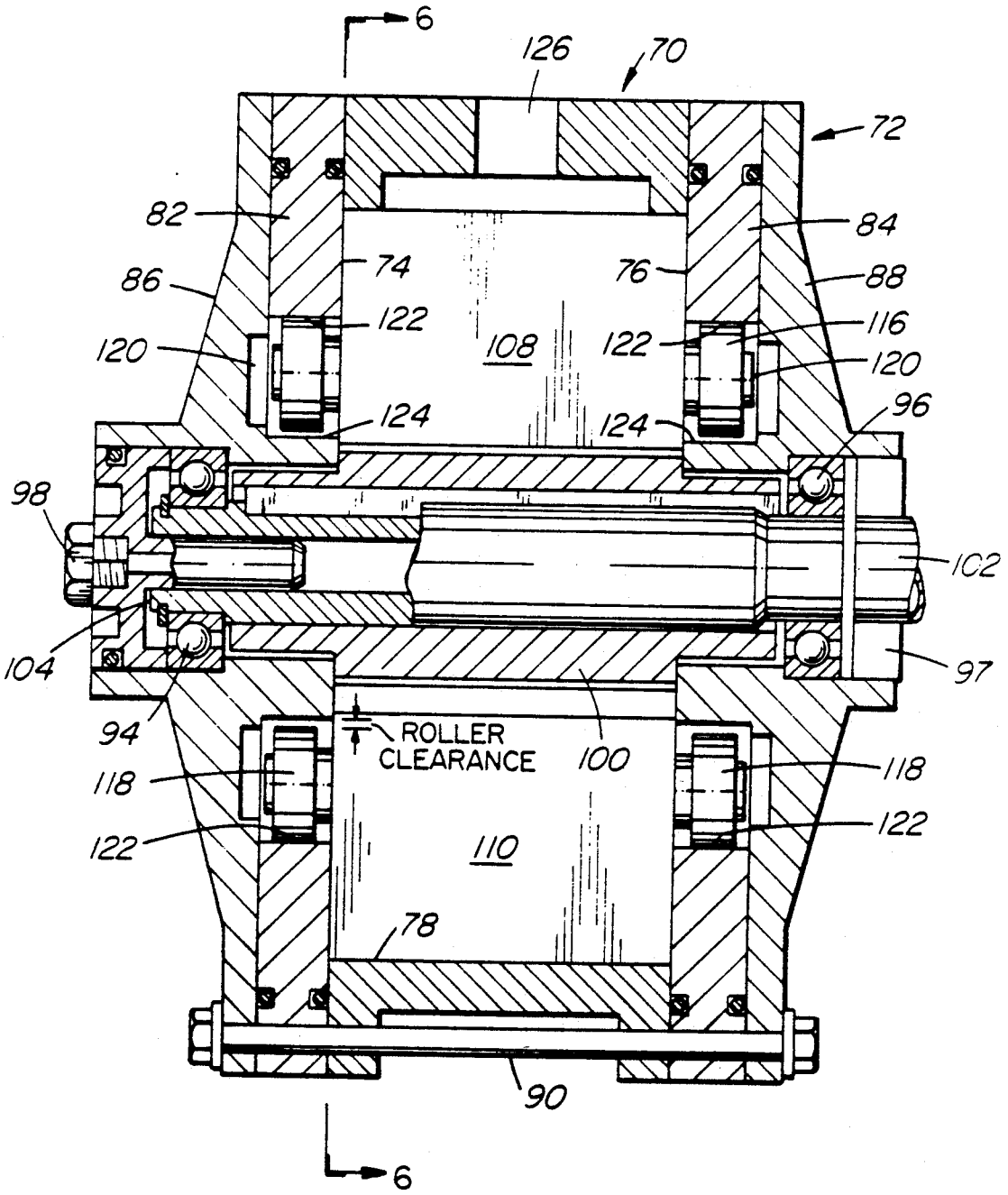

In general, the present invention incorporates vane-type rotary compressors and expanders of the type disclosed in U.S. Pat. Nos. 4,299,097 issued Nov. 10, 1981 and 4,410,305 issued Oct. 18, 1983, the disclosures of which are incorporated herein by reference. FIGS. 6 and 7 show a vane type compressor similar to the compressors described in the above two patents but differing therefrom in several important respects insofar as the geometry of the chamber or stator interior is concerned. (This same discussion can be applied to expanders). All of them enjoy the advantages conferred by vanes riding on rollers located in grooves or cam contours of predetermined shape so that vane tip friction is essentially eliminated; inlet and outlet port configuration is optomized and numerous other mechanical advantages are conferred thereby to provide for extremely high operating efficiency.

Turning again to the drawings there is illustrated in FIGS. 6 and 7 a compressor 70 comprising a stator housing 72 defining a chamber having opposed parallel end walls 74, 76 and a curved interior wall 78 extending about a chamber axis 80.

Forming the end walls 74, 76 of the chamber are end plates 82, 84 which are respectively mounted upon end pieces 86, 88 which are clamped together by bolts 90. The end pieces carry anti-friction bearings 94, 96 and an associated seal 97 centered about a rotor axis 98.

The bearings 94, 96 serve to journal a rotor 100 of cylindrical shape supported upon a shaft having a driving end 102, and a remote end 104. The rotor, dimensioned to fit between the end walls, has a plurality of spaced radially extending slots. Occupying the slots for sliding movement in the radial direction is a set of vanes 106–110 of rectangular shape and profiled to fit the stator chamber to define enclosed compartments between them.

Each vane has a pair of axially extending, aligned stub shafts having rollers mounted thereon. Each set of rollers, indicated at 114–118, is guided in a cam contour 120 having parallel side walls 122, 124. The outer side walls 122 form tracks for the vane rollers, the tracks being so profiled that when the vanes are urged outwardly the outer edges of the vanes follow in closely spaced proximity to the inner wall 78 of the stator chamber.

There is provided, on the stator chamber, an inlet port 126 for aspiration of gas into each compartment between adjacent vanes. There is also provided an outlet port 128 for discharging gas from each compartment in the compressed state. The curved interior wall 78 is recessed to provide peripheral pockets 130, 132, respectively, which extend the ports to minimize inlet and outlet fluid dynamic losses. A "tuck in" seal region 133 of the stator interior wall located between pockets 130, 132 is in close sealing engagement with the smooth outer periphery of the rotor thereby to prevent leakage of fluid from the high pressure outlet to the low pressure inlet side.

An expander according to the invention is also as described above and illustrated in FIGS. 6 and 7 except that the direction of the rotor is reversed and the positions of inlet and outlet ports 126, 128 and their associated pockets 130, 132 are interchanged.

It has been found that high volume ratio machines of the constrained rotary vane type as described can be created by three primary individual geometrical components and a single "x-offset" between the rotor 100 and the stator chamber inner wall 78. From FIG. 6, the stator chamber inner wall profile can be seen as including: (1) a quarter circle section 134; (2) a three-quarter elliptical section 136; (3) a short straight-line segment 138 between the quarter circle section 134 and (4) a rotor "x-offset" 140 from the center axis of the stator chamber profile on the x-axis. It will be noted that the left-bottom quadrant of the stator chamber in FIG. 6 arbitrarily contains the quarter circle section 134, the top two and lower right quadrants together contain the $\frac{3}{4}$ ellipse section and the short straight line segment 138 lies across the bottom of the lower right-hand quadrant from the bottom end-point of the quarter circle section to the bottom left end-point of the $\frac{3}{4}$ ellipse section. From point D to point E the stator ellipse is described as being "imaginary" since the actual stator interior wall in this area is occupied by the peripheral pockets 130, 132 and the seal region 133, the latter region actually defining a cylindrical surface centered with the axis of rotation of the rotor 100. From point E to point F (the remaining portion of the $\frac{3}{4}$ ellipse) the stator inner wall 78 conforms to the shape of the actual ellipse to be described hereafter.

The geometrical relationships are fairly simple and, if the radius of the quarter circular portion 134 of the stator chamber wall contour is called "R", then the $\frac{3}{4}$ ellipse portion 136 of the stator wall contour has a major axis equal to twice the sum of R and the x-offset between the ellipse center and the circle center, both of which lie on the x-axis. Also, it has been found that a very convenient value for the semi-minor axis of the elliptical portion of the stator chamber contour is simply the radius R of the circular portion 134 of the stator profile. (The radius of the rotor is only slightly less than radius R as shown in FIG. 6). Since the eccentricity of an ellipse is defined here as the arc cosine of the ratio of the minor to major axes of the ellipse, the eccentricity of the elliptical portion of the stator chamber can be easily computed. The X and Y coordinates of all points along the elliptical wall can also be easily calculated using standard mathematical techniques.

In FIG. 6, it can be seen that the center of the rotor 100 is coincident with the center of the quarter circle section 134 of the stator chamber profile—again, on the x-axis. This choice, with four rotating vanes 106–110, precisely causes the rate of inlet flow (as an expander) or the rate of outlet flow (as a compressor) to be a constant function of rotor speed. Furthermore, by choosing R as the value of the semi-minor axis of the stator chamber ellipse, it coincides nicely with an x-offset equal to about 1/5 of the rotor radius. This fraction, however, can change considerably with the choice of volume ratio. Nonetheless, these geometric values result in a configuration that is not only easy to understand and calculate, but its manufacture and dimensional inspection will be easier than with the earlier doubly-offset machine shown in U.S. Pat. No. 4,410,305.

It is noted that the high volume ratio machines described above have two specific characteristics related to gas dynamics: (1) the high pressure side, whether considering the machine a compressor or expander, has constant volume flow rate at constant rotor speed, and (2) the low pressure side, whether considering the machine a compressor or expander, has varying volume flow rate at constant rotor speed. However, the low pressure side is designed as described above in such a way that the rate of volume change dwells at zero or nearly zero during a large angular change of rotor position. This is important because this characteristic ensures that (a) when behaving as a compressor (such as in the Carnot compressor/pump embodiment), this zero-volume change secures an opportunity for the vane cavity to fill completely (i.e. there are no "wire-drawing" fluid pressure losses), and (b) when behaving as an expander (such as in the Carnot expander embodiment) no vane cavity pressure build-up occurs during the exhaust process.

The invention will be better understood from the following non-limiting example.

EXAMPLE

The various values of the state points of the Carnot engine cycle are computed below. The fundamental assumption is that the single-component mixed-phase working fluid exchanges heat rapidly enough to comprise a quasi-static thermal equilibrium. Further, the analysis assumes that the processes are, by initial definition, isentropic.

To start the analysis, state point (2) (post expansion) and state point (4) (post compressor/pump) are selected. For example, assume (specify) that state point (2) is saturated vapour at 40F, and that point (4) is saturated liquid at 180F. The problem is to find the properties of state points (1) (pre-expansion) and (3) (pre-compressor/pump). Since the state points in question (1 and 3) fall within the P-s dome, the quality of the mixture is non-zero and it exists, of course, at saturated conditions.

The quality of the mixture is defined as the ratio of the mass of the mixture in vapour form to the mass of the whole mixture.

In the following analysis:

h=enthalpy BTU/lb
s=entropy BTU/lb. F
x=quality
f=liquid
g=vapour.

THERMAL OPERATING CONDITIONS:

Normal butane R-600 is the working fluid

High Side: T high = 180 F., psat2 = 154.7 psia
Low Side: T low = 40 F., psat1 = 17.62 psia Pressure Ratio:

$$\text{pratio:} = \frac{\text{psat2}}{\text{psat1}} \qquad \text{pratio} = 8.779796$$

State Point (1):

$sf_2 = 1.0547 \quad sg_1 = 1.2473 \quad hg_1 = -564.1$ $vg_1 = 0.5976 \quad vf_1 = \frac{1}{31.17} \quad hf_1 = -687.5$ $s_2 = 1.2369$ (This is imposed upon the cycle)
The quality at state point (1) is calculated from:

$$x_1 = \frac{s_2 - sf_1}{sg_1 - sf_1} \qquad x_1 = 0.946002 \text{ (quality)}$$

Specific enthalpy:
$h_1 = x_1\, hg_1 + [1 - x_1]\, hf_1; \quad h_1 = -570.763344$
Specific volume:
$v_1 = x_1\, vg_1 + [1 - x_1]\, vf_1; \quad v_1 = 0.567063$ State Point (2):

$vg_2 = 4.998 \quad vf_2 = \frac{1}{37.22} \quad hf_2 = -770.7$ $x_2 = 1.000$ (Saturated gas condition)

Specific enthalpy:
$h_2 = x_2\, hg_2 + [1 - x_2]\, hf_2 \quad h_2 = -606.9$
Specific volume:
$v_2 = x_2\, vg_2 + [1 - x_2]\, vf_2 \quad v_2 = 4.998$ State Point (3):

$sf_3 = 0.9085 \quad sg_3 = 1.2369 \quad hg_3 = -606.9$ $vg_3 = 4.998 \quad vf_3 = \frac{1}{37.22} \quad hf_3 = -770.7$ Quality at State Point 3:

$s_4 = 1.0547$ (This is equal to the saturated liquid entropy at state point 4.)

$$x_3 = \frac{s_4 - sf_3}{sg_3 - sf_3} \qquad x_3 = 0.445189$$

Specific enthalpy:
$h_3 = x_3\, hg_3 + [1 - x_3]\, hf_3; \quad h_3 = -697.778076$
Specific volume:
$v_3 - x_3\, vg_3 + [1 - x_3]\, vf_3; \quad v_3 = 2.23996$ State Point (4):

$sf_4 = 1.0547 \quad sg_4 = 1.2473; \quad hg_4 = -564.1$ $vg_4 = 0.5976 \quad vf_4 = \frac{1}{31.17}; \quad hf_4 = -687.5$ $x_4 = 0.000$ (Saturated liquid condition)
Specific enthalpy:
$h_4 = x_4\, hg_4 + [1 - x_4]\, hf_4; \quad h_4 = -687.5$ -continued Specific volume:

$v_4 = x_4\, vg_4 + [1 - x_4]\, vf_4$; $v_4 = 0.032082$

CYCLE CALCULATIONS:

Specific Power:

$p: = [h_1 - h_2] - [h_4 - h_3]$; $p = 25.858581$ BTU/lb.

Expwork: $= [h_1 - h_2]$; Expwork $= 36.136656$ BTU/lb.

Compumpwork: $= [h_4 - h_3]$ Compumpwork $= 10.278076$ BTU/lb.

Ideal Thermal Conversion Efficiency:

$$\text{eff} = \frac{P}{h_1 - h_4} \quad \frac{25.858}{116.736} = \text{eff} = 0.221512$$

EFFY = 22.151209 (approx. same as below)

$$\text{CARNOT EFFICIENCY} = \frac{\text{THIGH} - \text{TLOW}}{\text{THIGH} + 459.69} \times 100 =$$

21.8856(The difference from the above represents a .4% error in tabulated property data)

VOLUME RATIOS:

Expander:

$$Vre = \frac{v_2}{v_1} = \frac{4.998}{.567063} = Vre = 8.813832$$

Compressor/Pump: = 9:1 approx.

$$Vrcp = \frac{v_3}{v_4} = \frac{2.2399}{.032082} = Vrcp = 69.819549 \text{(about 70:1)}$$

$Vrcp$ = 70:1 approx

IDEAL MASS FLOW RATES:

$Q$ = 100000 Watts, nominal engine output $$\text{Mdot} = \frac{Q\, 3.412969}{p} = \frac{10^5 \times 3.412969}{25.858}$$

Mdot = $1.319859 \times 10^4$ Pounds/Hr.

$$\text{Mdotmin} = \frac{\text{Mdot}}{60}; \quad \text{Mdotmin} = 219.976561 \text{ Pounds/Min}$$

n-Butane Flow Per Expander Revolution at RPM speed:

RPM = 1800

$$\text{Mdispl} = \frac{\text{Mdotmin}}{\text{RPM}}$$

Mdispl = 0.122209 lb.

Maximum Volumetric Displacement of Expander:

Expdispl = Mdispl $[v_2]$

Expdispl = 0.610802

Max Displacement per Segment (4-vane):

$$\text{Displ Exp} = \frac{\text{Expdispl}}{4}$$

Displ Exp = 0.1527 Cubic Feet per rev per Segment

= 263.366 cubic inches per rev per vane Segment

Maximum Volumtric Displacement of Compressor/Pump $$\text{Compumpdispl} = \text{Mdotmin} \times \frac{v_3}{\text{RPM } 4}$$

Compumpdispl = 0.068436 cubic feet per rev per Segment

= 118.2573 cubic inches per rev per Segment.

The above ideal example therefore not only establishes the values of the state points under the conditions given, but it also enables specific power to be calculated along with thermal efficiency of the cycle, volume ratios for the compressor/pump and expander, mass flow rates and maximum volumetric displacements for the expander and compressor/pump. Using the geometrical relationships described above together with these values the detailed engineering design for both the compressor/pump and expander can be accomplished. By providing expanders and compressors of the "volume change" or positive displacement type described above as opposed to turbine machines, problems of turbine blade pitting and erosion are non-existent. The dual phase mixture of droplets suspended in vapour is tolerated very well in the vane type compressors and expanders as described. Moreover, these same machines provide the very high volume ratios needed for the reasons as described above.

Those skilled in this art will realize that the ideal expander and compressor designs can only be approached as a limit. Hence, all references to isentropic expansion and compression are to be interpreted in a general sense only and not in a narrow restricted sense. There will always be some losses during expansion and compression. At the same time it will be appreciated that compressor and expander efficiencies of over 90% or thereabouts will be required if the Carnot cycle approximation here described is to have any appreciable advantage over the conventional Rankine cycle. This is particularly true in the case of the compressor owing to the fact that the pump work factor in a Carnot cycle is a relatively large percentage of the expander output work as compared with the conventional Rankine cycle as noted previously. The low friction roller mounted vanes and favourable fluid dynamics associated with the compressor and expander described above greatly assist in providing the high efficiencies needed.

THE CARNOT REFRIGERATION AND HEAT PUMP CYCLES

Figure 8A:
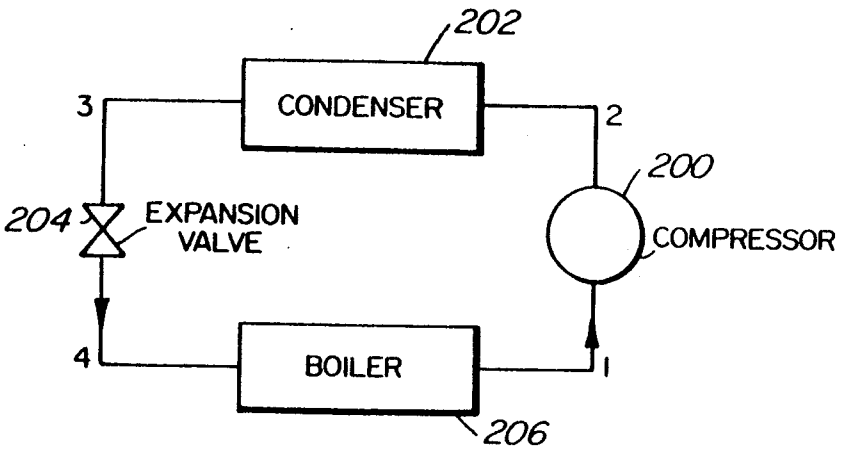
FIGS. 8A and 8B are schematic (conventional) refrigeration/heat pump systems and cycle diagrams respectively.
Figure 8B:
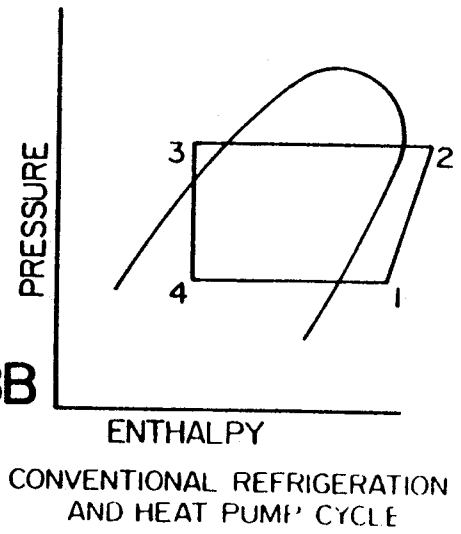

Referring now to FIGS. 8A and 8B there is shown a conventional refrigerator or heat pump and its vapor cycle. The working fluid or refrigerant is compressed between state points (1) and (2) by compressor 200, ending with superheated vapor. Cooling and condensing takes place between state points (2) and (3) in condenser 202 with heat being transferred out of the system. Throttling between state points (3) and (4) by way of throttling valve 204 then occurs with the enthalpy remaining unchanged. (There is no heat transfer). Evaporation, a constant pressure process, occurs between (4) and (1) in boiler 206 to complete the cycle, this being the process in which the refrigerating effect occurs as heat is transferred to the evaporating fluid.

Figure 9A:
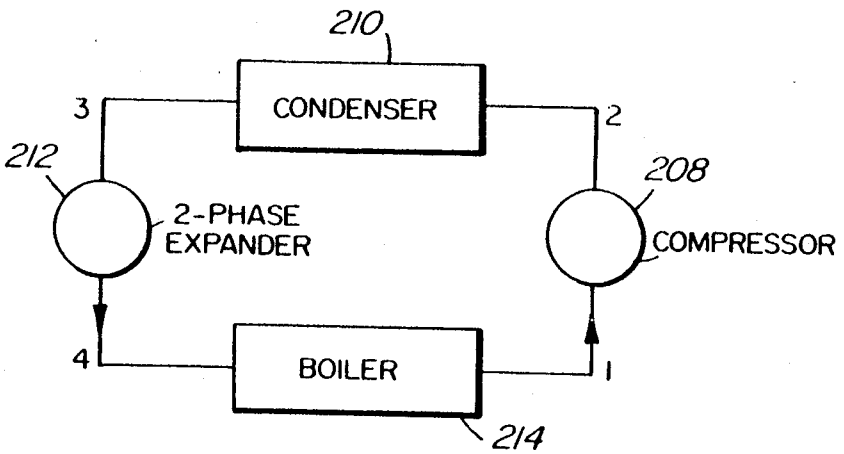
FIGS. 9A and 9B are schematic refrigeration/heat pump systems and cycle diagrams respectively, illustrating a further aspect of the invention.
Figure 9B:
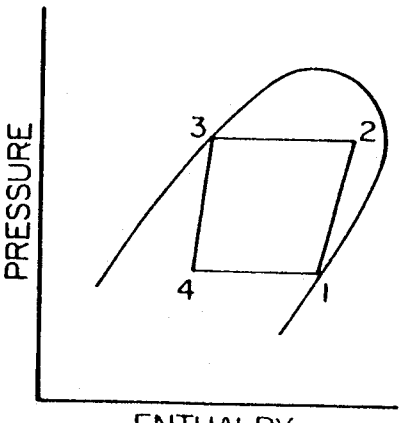

Referring now to FIGS. 9A and 9B there is shown a Carnot refrigeration and heat pump cycle. The equipment uses a two phase rotary expander 212 and a two-phase rotary compressor 208, both constructed as described with reference to FIGS. 6 and 7 so the detailed mechanical description need not be repeated here. Furthermore, the inlet line to the compressor 208 is provided with a liquid phase injection pump and spray nozzle essentially the same as pump 22 and nozzle 24 described with reference to the Carnot engine and with reference to FIG. 5. Similarly, the inlet line to the two-phase expander 212 is provided with a liquid phase injection nozzle and pump essentially the same as the nozzle 20 and pump 18 again as described with reference to FIG. 5. The condenser and boiler may be of a generally conventional nature except that means should be provided to control the liquid levels in both units to ensure good heat transfer efficiency, as by suitably arranging the levels of the inlets to the liquid phase pumps as described previously.

With reference to FIG. 9B compressor process (1)-(2) (which is approximately isentropic) starts with saturated liquid and ends "inside the dome" with a compressed two phase fluid. Cooling and condensing from state points (2) to (3) ends at the saturated liquid line with subsequent expansion (approximately isentropic) in the two phase expander 212 from point (3) to (4) providing a two-phase fluid which is then evaporated in boiler 214 to produce the desired cooling effect. During the expansion in expander 212, some useful work is produced and this energy is fed back into the system, i.e. to complement the shaft work input to the compressor 208 in any suitable manner.

The phenomena described previously in connection with the Carnot engine, i.e. the continuous thermodynamic property changes that the mixed-phase working fluid undergoes as heat is transferred across the liquid-to-vapour and vapour-to-liquid boundaries created by the fine mixture of liquid and gas, applies equally in this case during the compression and expansion processes.

The coeffecient of performance (COP) of a refrigeration or heat pump machine can be expressed as:

$$COP = \frac{\text{useful thermal effect}}{\text{net power input}}$$

In case of the refrigeration apparatus in FIGS. 9A and 9B the useful thermal effect is the heat absorbed (1–4), while in a heat pump the useful thermal effect is the heat output (2–3). Using the values of FIG. 4 for perfect isentropic expansion and compression we obtain:

$$\text{refrigeration machine } COP = \frac{(75.81 - 48.1)}{(88.07 - 75.81) - (52.687 - 48.1)} = 3.611$$

$$\text{heat pump } COP = \frac{88.07 - 52.687}{(88.07 - 75.81) - (52.687 - 48.1)} = 4.61$$

By way of comparison, the heat pump COP when using a prior art expansion valve is only 2.9 so the two-phase cycle of the present invention could provide a COP improvement approaching 60% if compressor/expander efficiencies can be made to approach 100%. As compressor/expander efficiencies drop off the COP improvement will of course be reduced.

The comments made previously noting that ideal expander and compressor designs can only be approached as a limit and that all references to isentropic expansion and compression are to be taken in a general sense and not in a narrow restricted sense apply to the refrigeration/heat pump cycle as well. High compressor and expander efficiencies (90+%) are required as noted before and the low friction roller mounted vane-type machines described herein greatly assist in providing the required efficiencies as well as handling the very wet vapours required by the cycle.

What is claimed is:

1. A heat engine cycle comprising:

(a) compressing in a compressor a dual-phase working fluid in the form of a mixture of fine droplets of saturated liquid in saturated vapour;

(b) heating the working fluid as compressed in step (a) under substantially isothermal conditions while vaporizing the working fluid;

(c) expanding the heated working fluid provided by step (b) in an expander to produce a work output while the working fluid, during at least an initial portion of the expansion, is in the form of a mixture of fine droplets of saturated liquid in saturated vapour;

(d) cooling and partially condensing the working fluid after the expansion step (c) under substantially isothermal conditions to provide a dual-phase working fluid mixture of saturated vapour and saturated liquid for compression in step (a); and (e) repeating the steps (a)–(d) recited above in a continuous cycle.

2. The heat engine cycle of claim 1 wherein compression step (a) and expansion step (c) both proceed under approximately isentropic conditions.

3. The heat engine cycle of claim 1 or 2 wherein the working fluid is supplied to each of said expander and said compressor as a flow of saturated vapour within which is entrained a fine mist of the saturated liquid component.

4. The heat engine cycle of claim 3 wherein, during the expansion step, (i) sufficient saturated liquid is entrained in the saturated vapour and (ii) the degree of expansion is such that at the end of the expansion step, the working fluid is substantially in the form of saturated vapour.

5. The heat engine cycle of claim 4 wherein, during the compression step, (i) sufficient saturated liquid is entrained in the saturated vapour entering the compressor and (ii) the degree of compression is such that the working fluid at the end of the compression step is substantially in the form of saturated liquid.

6. The heat engine cycle of claim 3 wherein a boiler is provided to effect the heating of the working fluid and wherein means are provided to supply the fine mist of the saturated liquid component to the expander, said means being arranged to receive its supply of satuarated liquid from said boiler at such a rate and from a location in said boiler so as to assist in maintaining a maximum desired level of saturated liquid in the boiler to help optimize the rate of heat transfer to the working fluid.

7. The heat engine cycle of claim 6 wherein a condenser is provided to effect condensing of a portion of the working fluid, and further means to supply the fine mist of the saturated liquid to the compressor, said further means being arranged to receive its supply of saturated liquid from said condenser at a rate and from a location in said condenser so as to assist in maintaining a desired minimum level of saturated liquid in the condenser to help optimize the rate of heat transfer from the working fluid.

8. The heat engine cycle of claim 3 wherein both the compressor and the expander comprise rotary vane machines each comprising a rotor located in a chamber having an inner wall of predetermined contour, and said vanes being constrained for movement during rotation of said rotor to define variable volumes between the inner wall of the chamber, the vanes, and the rotor, which volumes vary from a maximum to a minimum during rotor rotation, and inlet and outlet ports in said chamber for ingress and egress respectively of the working fluid as the rotor rotates.

9. The heat engine cycle of claim 8 wherein said vanes are rollingly supported and constrained for motion in a predetermined path during rotor rotation whereby friction between the vanes, the inner wall of the chamber and the rotor is minimized.

10. The heat engine cycle of claim 8 wherein the compression and expansion steps are carried out between state points having specific volumes associated therewith such that said compressor requires a volume ratio of approximately 70 to 1, and said expander requires a volume ratio of approximately 9 to 1.

11. The heat engine cycle of claim 9 wherein the compression and expansion steps are carried out between state points having specific volumes associated therewith such that said compressor requires a volume ratio of approximately 70 to 1, and said expander requires a volume ratio of approximately 9 to 1.

12. The heat engine cycle of claim 3 wherein said working fluid is a single component fluid.

13. An approximate Carnot heat engine cycle including the steps of:

(a) compressing a working fluid in a compressor the working fluid being comprised of a saturated liquid saturated vapour mixture created by feeding the saturated vapour component into an inlet of the compressor together with a fine mist or spray of the saturated liquid component so that heat transfer occurs during the compression process across the liquid-vapour boundaries defined by the finely divided mixture of vapour and liquid and so that the compression of this mixture proceeds under approximately isentropic conditions until a desired degree of compression is achieved;

(b) heating the compressed working fluid produced by step (a) under substantially isothermal conditions to vaporize a substantial portion of the working fluid to produce a two-phase saturated liquid-saturated vapour mixture;

(c) expanding the heated two-phase working fluid produced in step (b) in an expander to produce a work output from the expander by feeding the vapour phase into the expander together with a fine spray or mist of the saturated liquid phase so that heat transfer occurs during the expansion process across the liquid-vapour boundaries defined by the finely divided mixture of vapour and liquid and so that the expansion proceeds under approximately isentropic conditions until a preselected pressure is reached;

(d) cooling and partially condensing the working fluid at the pre-selected pressure of step (c) under substantially isothermal conditions to reduce the quality of the resulting saturated vapour and saturated liquid mixture to a selected point for compression in step (a), and (e) repeating steps (a) through (d) as a continuous cycle.

14. The heat engine cycle of claim 13 wherein both the compression step (a) and the expansion step (c) comprise feeding the working fluid into respective rotary vane machines each of which comprises a rotor located in a chamber having an inner wall of predetermined contour, and said vanes being constrained for movement during rotation of said rotor to define variable volumes between the inner wall of the chamber, the vanes, and the rotor, which volumes vary from a maximum to a minimum during rotor rotation, and inlet and outlet ports in said chamber for the feeding and exhaust respectively of the working fluid as the rotor rotates.

15. The heat engine cycle of claim 14 wherein for each said machine said vanes are rollingly supported and constrained for motion in a predetermined path during rotor rotation whereby friction between the vanes, the inner wall of the chamber and the rotor is minimized.

16. The heat engine cycle of claim 15 wherein the compression and expansion steps are carried out between state points having specific volumes associated therewith such that said compressor requires a volume ratio of approximately 70 to 1, and said expander requires a volume ratio of approximately 9 to 1.

17. A heat engine comprising:

(a) a compressor having an inlet and an outlet and adapted for receiving and compressing a dual-phase working fluid in the form of a mixture of fine droplets of saturated liquid in saturated vapour;

(b) a boiler having an inlet and an outlet and connected to receive the working fluid from the compressor via the boiler inlet for heating the working fluid under substantially isothermal conditions so that the saturated liquid phase is converted gradually to vapour through the addition of heat;

(c) a boiler outlet line to carry a flow of heated working fluid from the boiler outlet to an expander inlet;

(d) an expander having said inlet and an outlet and adapted for receiving and expanding the heated working fluid provided by said boiler to produce a work output while the working fluid during at least a substantial initial portion of the expansion is in the form of a dual phase mixture of fine droplets of saturated liquid in saturated vapour;

(e) a condenser having an inlet and an outlet, said condenser having its inlet connected to the expander outlet for receiving and cooling and partially condensing the working fluid after the expansion in the expander to provide a dual-phase working fluid comprising saturated vapour and saturated liquid of pre-selected quality; and (f) a compressor inlet line to carry the flow of working fluid from the condenser outlet to the compressor inlet to provide for operation in a closed continuous cycle.

18. The heat engine of claim 17 including means to produce a mist or spray of fine droplets of saturated liquid in the flow of heated working fluid from said boiler outlet to said expander inlet to provide said dual-phase mixture of fine droplets of saturated liquid in saturated vapour for expansion in said expander.

19. The heat engine of claim 18 wherein said means to produce mist or spray comprises a spray nozzle in the boiler outlet line and connected to receive a flow of saturated liquid working fluid from said boiler.

20. The heat engine of claim 18 including further means to produce a mist or spray of fine droplets of saturated liquid in the flow of cooled working fluid from said condenser to said compressor to provide the dual-phase mixture of fine droplets of saturated liquid in saturated vapour for compression in said compressor.

21. The heat engine of claim 20 wherein said further means comprises a spray nozzle in said compressor inlet line and connected to receive a flow of working fluid from said condenser which is in the saturated liquid state.

22. The heat engine of claim 19 wherein said means to produce the mist or spray of the saturated liquid is arranged to receive its supply of saturated liquid from said boiler at a rate and from a location in said boiler so as to assist in maintaining a desired maximum level of saturated liquid in the boiler to help optimize the heat transfer rate therein to the working fluid.

23. The heat engine of claim 21 wherein said further means to supply the mist or spray of the saturated liquid is arranged to receive its supply of saturated liquid from said condenser at a rate and from a location in said condenser so as to assist in maintaining a desired minimum level of saturated liquid in the condenser to help optimize the rate of the heat transfer out of the working fluid.

24. The heat engine of claim 20 wherein both the compressor and the expander comprise rotary vane machines each of which comprises a rotor located in a chamber having an inner wall of predetermined contour, and said vanes being constrained for movement during rotation of said rotor to define variable volumes between the inner wall of the chamber, the vanes, and the rotor, which volumes vary from a maximum to a minimum during rotor rotation, and inlet and outlet ports in said chamber for ingress and egress respectively of the working fluid as the rotor rotates.

25. The heat engine of claim 24 wherein for each said rotary vane machine said vanes are rollingly supported and constrained for motion in a predetermined path during rotor rotation whereby friction between outer extremities of the vanes and the inner wall of the chamber is minimized.

26. The heat engine of claim 25 wherein for each said rotary vane machine said rotor is of cylindrical configuration and said chamber wall having an elliptical wall section disposed such that on rotation of the rotor said volumes are caused to vary as said vanes move in close proximity thereto.

27. The heat engine of claim 26 wherein for each said rotary vane machine said chamber wall further has a part circular section with said rotor surface being movable in close proximity thereto.

28. The heat engine of claim 27 wherein for each said rotary vane machine said circular section is substantially a quater circle section, and the remainder of the chamber wall being partially defined by an ellipse having a major axis in the X direction and a minor axis in the Y direction, said quarter circle section having its circle center offset in the X direction from the center of the ellipse, said quarter circle section having a radius R and said ellipse having its major axis equal to twice the sum of R and said offset in the X direction and its minor axis equal to R, a substantially straight line wall segment of extent equal to the offset distance between said quarter circle section and the elliptical section, and the remainder of the chamber wall comprising two sections, namely, a first section adjoining the straight line segment, which first section has a shape corresponding to said ellipse, and a second section extending from the first section to said quarter circle section which contains a spaced-apart pair of pockets each communicating with a respective one of said inlet and outlet ports, and a sealing region between said pockets in sealed relation to the surface of said rotor.

29. The heat engine of any one of claims 17 through 28 wherein said compressor and said expander are adapted to compress and expand respectively said dual-phase working fluid under approximately isentropic conditions.

* * * * *